US007605806B2

(12) United States Patent
Chen et al.

(10) Patent No.: US 7,605,806 B2
(45) Date of Patent: Oct. 20, 2009

(54) DATA DRIVING SYSTEM AND METHOD FOR ELIMINATING OFFSET

(75) Inventors: Ying-Lieh Chen, Hsinhua (TW); Lin Kai Bu, Hsinhua (TW)

(73) Assignee: Himax Technologies, Inc., Tainan (TW)

( * ) Notice: Subject to any disclaimer, the term of this patent is extended or adjusted under 35 U.S.C. 154(b) by 690 days.

(21) Appl. No.: 11/185,904

(22) Filed: Jul. 20, 2005

(65) Prior Publication Data

US 2006/0017680 A1 Jan. 26, 2006

(30) Foreign Application Priority Data

Jul. 23, 2004 (TW) ..... 93122181 A

(51) Int. Cl.
*G09G 5/00* (2006.01)

(52) U.S. Cl. ..... 345/204; 345/205; 345/206; 345/690; 345/691; 345/692; 345/693

(58) Field of Classification Search ..... 345/204–206, 345/690–693
See application file for complete search history.

(56) References Cited

U.S. PATENT DOCUMENTS 6,734,723 B2 * 5/2004 Huijsing et al. ..... 330/9
6,987,499 B2 * 1/2006 Yamaguchi et al. ..... 345/89
2002/0075212 A1 * 6/2002 Song ..... 345/87
2002/0158997 A1 * 10/2002 Fukami et al. ..... 349/49
2004/0109122 A1 * 6/2004 Kumagawa et al. ..... 349/143
2006/0221035 A1 * 10/2006 Lee ..... 345/94

* cited by examiner

*Primary Examiner*—Richard Hjerpe
*Assistant Examiner*—Leonid Shapiro
(74) *Attorney, Agent, or Firm*—Ladas & Parry LLP

(57) ABSTRACT

The present invention relates to a data driving system and method for driving a panel. The data driving system comprises: a gamma voltage supply and a D/A converter. The gamma voltage supply produces a plurality of gamma voltages. The D/A converter receives the gamma voltages, a first pixel value and a second pixel value, and converts the first pixel value and the second pixel value to a corresponding gamma voltage in the gamma voltages. When the D/A converter converts the first pixel value, the gamma voltages have a first polarity offset. When the D/A converter converts the second pixel value, the gamma voltages have a second polarity offset. Because the data driving system of the invention periodically switches the first polarity offset and the second polarity offset of the gamma voltage supply, an offset in the driving voltage is eliminated by the first polarity (positive) offset and the second polarity (negative) offset in space and time. Therefore, there is no band mura in the panel.

15 Claims, 7 Drawing Sheets

| | | | |
|---|---|---|---|
| +(+) | -(+) | +(+) | -(+) |
| -(+) | +(+) | -(+) | +(+) |
| +(-) | -(-) | +(-) | -(-) |
| -(-) | +(-) | -(-) | +(-) |
| +(+) | -(+) | +(+) | -(+) |
| -(+) | +(+) | -(+) | +(+) |
| +(-) | -(-) | +(-) | -(-) |
| -(-) | +(-) | -(-) | +(-) |

FIG.5

| | | | |
|---|---|---|---|
| +(+) | -(+) | +(+) | -(+) |
| +(-) | -(-) | +(-) | -(-) |
| -(+) | +(+) | -(+) | +(+) |
| -(-) | +(-) | -(-) | +(-) |
| +(+) | -(+) | +(+) | -(+) |
| +(-) | -(-) | +(-) | -(-) |
| -(+) | +(+) | -(+) | +(+) |
| -(-) | +(-) | -(-) | +(-) |

FIG.7

F1

| | | | |
|---|---|---|---|
| +(+) | -(+) | +(+) | -(+) |
| -(+) | +(+) | -(+) | +(+) |
| +(-) | -(-) | +(-) | -(-) |
| -(-) | +(-) | -(-) | +(-) |
| +(+) | -(+) | +(+) | -(+) |
| -(+) | +(+) | -(+) | +(+) |
| +(-) | -(-) | +(-) | -(-) |
| -(-) | +(-) | -(-) | +(-) |

F2

| | | | |
|---|---|---|---|
| -(+) | +(+) | -(+) | +(+) |
| +(+) | -(+) | +(+) | -(+) |
| -(-) | +(-) | -(-) | +(-) |
| +(-) | -(-) | +(-) | -(-) |
| -(+) | +(+) | -(+) | +(+) |
| +(+) | -(+) | +(+) | -(+) |
| -(-) | +(-) | -(-) | +(-) |
| +(-) | -(-) | +(-) | -(-) |

F3

| | | | |
|---|---|---|---|
| +(-) | -(-) | +(-) | -(-) |
| -(-) | +(-) | -(-) | +(-) |
| +(+) | -(+) | +(+) | -(+) |
| -(+) | +(+) | -(+) | +(+) |
| +(-) | -(-) | +(-) | -(-) |
| -(-) | +(-) | -(-) | +(-) |
| +(+) | -(+) | +(+) | -(+) |
| -(+) | +(+) | -(+) | +(+) |

F4

| | | | |
|---|---|---|---|
| -(-) | +(-) | -(-) | +(-) |
| +(-) | -(-) | +(-) | -(-) |
| -(+) | +(+) | -(+) | +(+) |
| +(+) | -(+) | +(+) | -(+) |
| -(-) | +(-) | -(-) | +(-) |
| +(-) | -(-) | +(-) | -(-) |
| -(+) | +(+) | -(+) | +(+) |
| +(+) | -(+) | +(+) | -(+) |

FIG.6

DATA DRIVING SYSTEM AND METHOD FOR ELIMINATING OFFSET

BACKGROUND OF THE INVENTION

1. Field of the Invention

The present invention relates to a method for driving a display, and more particularly to a data driving system and method for driving a display, wherein an offset in the driving voltage is eliminated by the first polarity (positive) offset and the second polarity (negative) offset in space and time.

2. Description of the Related Art

Referring to FIG. 1, a panel 11 (e.g. a liquid crystal panel) is driven by a plurality of data driving systems 10 (e.g. two data driving systems in the figures) to display images. Each data driving system 10 obtains a plurality of reference voltages $VR_1$~$VR_m$ from a reference voltage supply (not shown), and receives the pixel values over the channels $ch_1$~$ch_n$ so as to convert the pixel values into the analog driving voltages, and sends in parallel the driving voltages on these channels to a set of corresponding data lines on the panel 11 according to the scanning timing and data polarity inversion timing. Each data driving system 10 comprises a gamma voltage supply 101, a D/A converter (DAC) 103, an output buffer 105 and a multiplexer 107.

The gamma voltage supply 101 comprises a plurality of operational amplifiers $OP_1$~$OP_m$ and resistors $R_1$~$R_i$. Each of the operational amplifiers $OP_1$~$OP_m$ is used as the input buffer for each of the reference voltages $VR_1$~$VR_m$, in order to prevent the change of the reference voltage caused by its load. After being received and output by the buffers, the reference voltages are divided by means of the resistors $R_1$~$R_i$, thus generating two sets of gamma voltages with positive and negative data polarity respectively, such as $V_0^+$~$V_{63}^+$ and $V_0^-$~$V_{63}^-$, and then these gamma voltages are input to the D/A converter 103. The D/A converter 103 may output a corresponding gamma voltage of the two sets of gamma voltages for each channel, based on the pixel value and data polarity of the channel. The voltage output by the D/A converter 103 is then output as a driving voltage via the output buffer 105. The multiplexer 107 is used to switch the connection between the output channels of the data driving system and the panel's data lines in conjunction with the data polarity inversion timing, so as to achieve different driving modes, including frame inversion, row inversion, column inversion, dot inversion or two dot lines inversion and the like.

However, since the outputs of the operational amplifiers have an inherent positive or negative polarity offset, the gamma voltages output by the gamma voltage supply also have the same polarity offset, thereby the final driving voltages produced have the same polarity offset, too. Moreover, as the offset output from one operational amplifier is different from that of another, and the gamma voltage supply in each data driving system employs a group of operational amplifiers respectively, the offset of the driving voltages generated in each module is different. Therefore, the distinct luminance or color difference occurs between the vertical band regions driven by different data driving systems on the panel due to the different offsets in the driving voltages of each module, thus forming the so-called "band mura".

Therefore, it is necessary to provide a novel and inventive data driving system and method to solve the above problems.

SUMMARY OF THE INVENTION

The object of the present invention is to provide a data driving system and method for driving a panel. The data driving system comprises: a gamma voltage supply and a D/A converter. The gamma voltage supply produces a plurality of gamma voltages. The D/A converter receives the gamma voltages, a first pixel value, and a second pixel value, and converts the first pixel value and the second pixel value to a corresponding gamma voltage among the gamma voltages. When the D/A converter converts the first pixel value, the gamma voltages have a first polarity offset. When the D/A converter converts the second pixel value, the gamma voltages have a second polarity offset.

Because the data driving system of the invention periodically switches the first polarity offset and the second polarity offset of the gamma voltage supply, an offset in the driving voltage is eliminated by the first polarity (positive) offset and the second polarity (negative) offset in space and time. The offset in the driving voltage of each data driving system is eliminated, so there is no band mura in the panel.

BRIEF DESCRIPTION OF THE DRAWINGS

FIG. 5 illustrates the data polarities and the offset polarities of the driving voltages corresponding to partial pixels in the band region driven by the data driving system in the first embodiment of the present invention;

FIG. 6 illustrates the data polarities and the offset polarities of the pixels of four continuous frames in the first embodiment of the present invention;

FIG. 7 illustrates the data polarities and the offset polarities of the driving voltages corresponding to partial pixels in the band region driven by the data driving system in the second embodiment of the present invention;

DETAILED DESCRIPTION OF THE INVENTION

Figure 1:
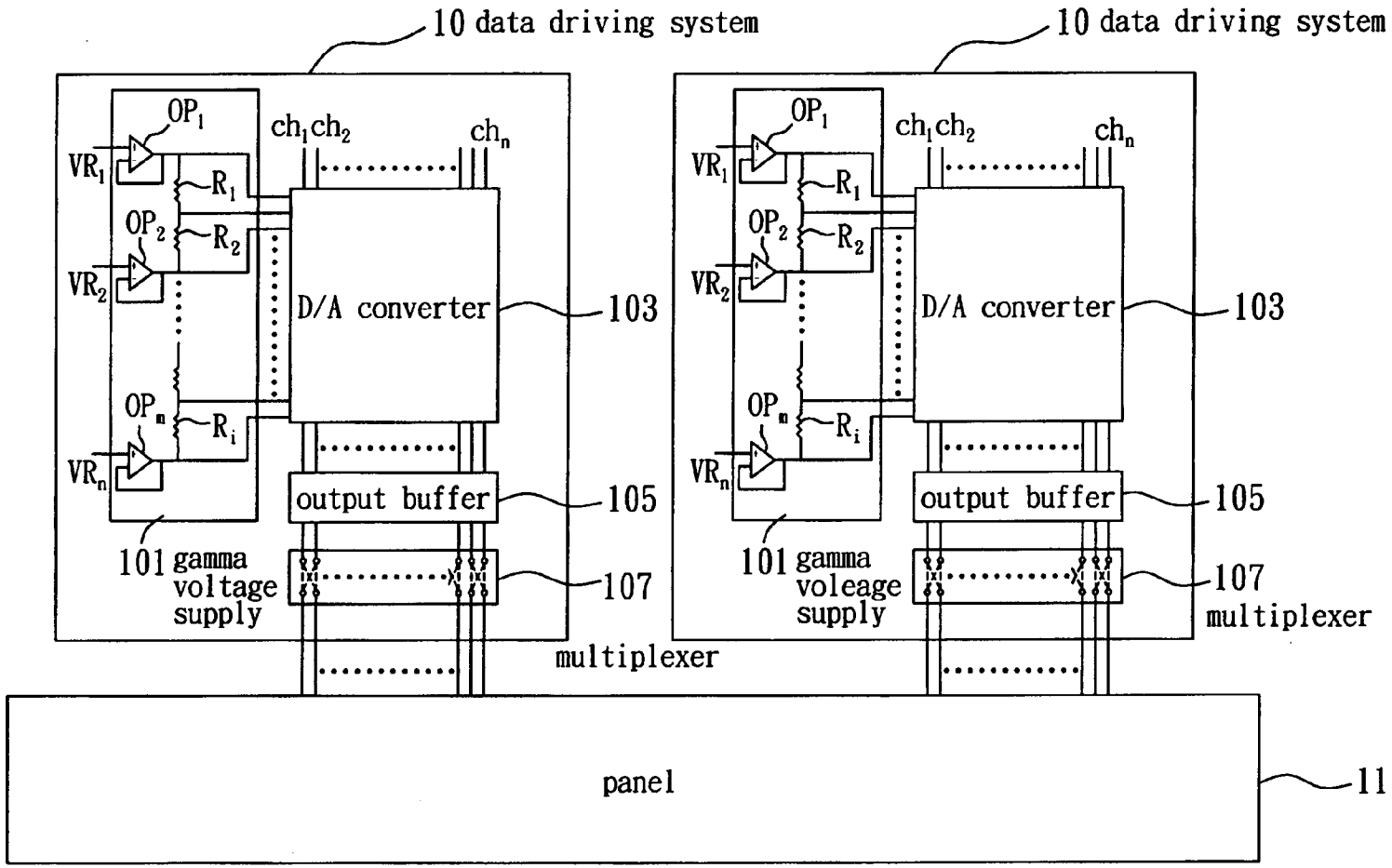
FIG. 1 illustrates a conventional data driving system.
Figure 2:
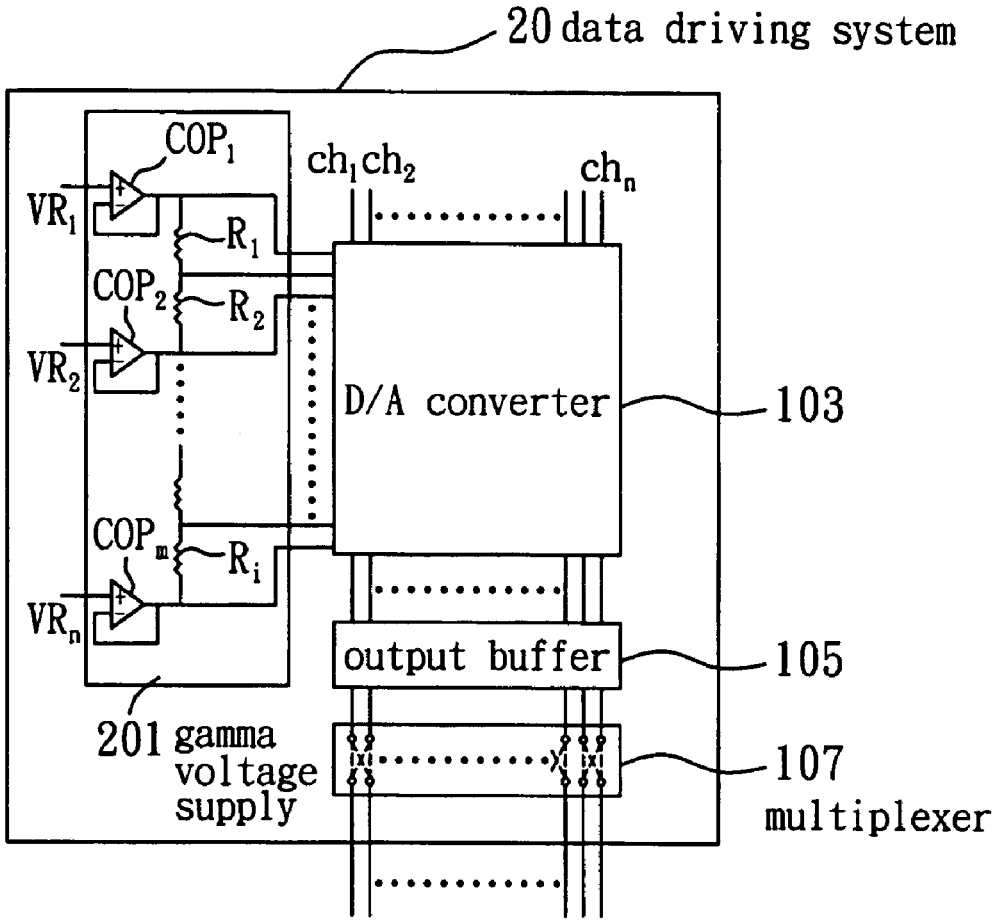
FIG. 2 illustrates the data driving system of the present invention.

Referring to FIG. 2, the schematic view of the data driving system 20 according to one embodiment of the present invention is shown. The same elements of FIGS. 1 and 2 are indicated by the same symbols for the sake of brevity. The data driving system 20 comprises a gamma voltage supply 201, a D/A converter 103, an output buffer 105 and a multiplexer 107. The gamma voltage supply 201 comprises a plurality of chopper operational amplifiers $COP_1$~$COP_m$, and resistors $R_1$~$R_i$. It is known from FIG. 2 that the main difference between the data driving system 20 and the conventional data driving system 10 resides in that the gamma voltage supply 201 employs the chopper operational amplifiers $COP_1$~$COP_m$ as the input buffers for the reference voltages $VR_1$~$VR_m$. The structure and operation of the chopper operational amplifier will be described specifically below.

Figure 3A:
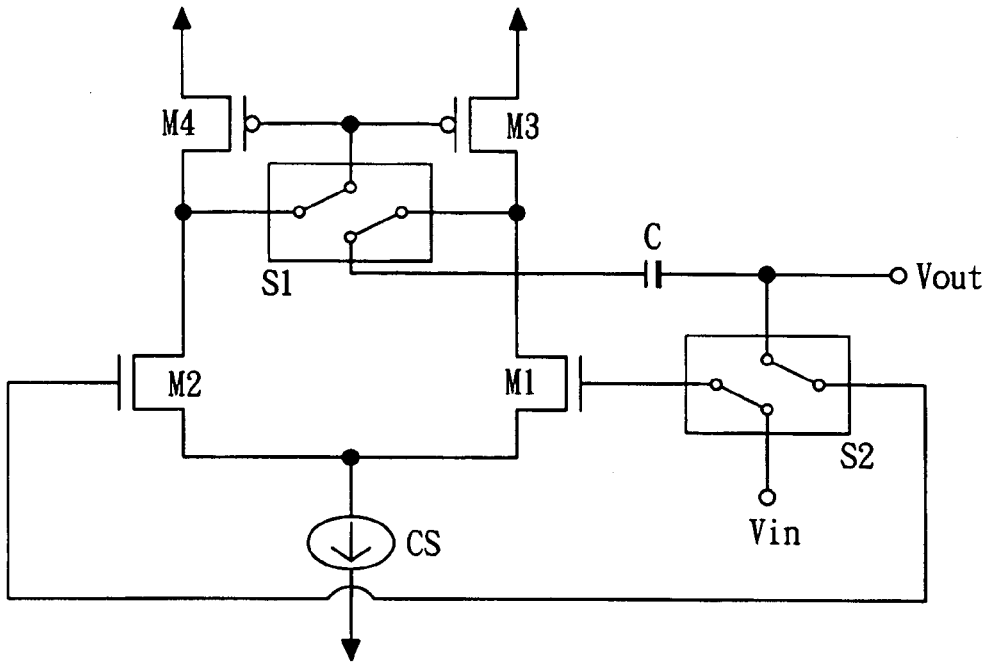
FIG. 3A illustrates the chopper operational amplifier, being operated in the first state.

Referring to FIG. 3A, each of the chopper operational amplifiers $COP_1$~$COP_m$, including transistors M1~M4, a capacitor C, a current source CS, and switches S1, S2, receives the reference voltage from an input terminal Vin and outputs it via an output terminal Vout. The source of the transistor M3 is connected to receive a positive supply voltage. The gate of the transistor M4 is connected to the gate of the transistor M3, and its source is connected to receive said positive supply voltage. The drain of the transistor M1 is connected to the drain of the transistor M3. The drain of the transistor M2 is connected to the drain of the transistor M4, and its source is connected to the source of the transistor M1. The current source CS is connected to the sources of the transistors M1 and M2. The capacitor C is connected between the switch S1 and the output terminal Vout. There are two operational states each for either of the switches S1 and S2, which will be described with reference to FIGS. 3A and 3B.

Figure 4A:
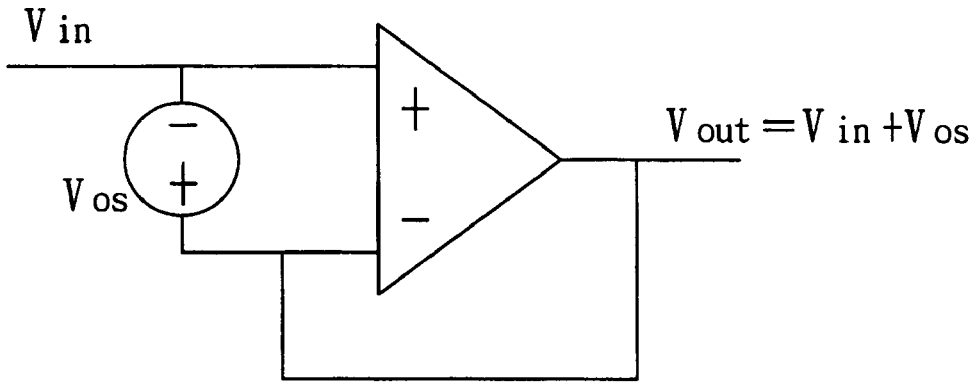
FIG. 4A is an equivalent circuit diagram of the chopper operational amplifier, being operated in the first state.

As shown in FIG. 3A, the switch S1 connects the gates of the transistors M3 and M4 to the drain of the transistor M4, and connects the drain of the transistor M3 to the capacitor C, while the switch S2 connects the gate of the transistor M2 to the output terminal Vout, and connects the gate of the transistor M1 to the input terminal Vin. As such, the chopper operational amplifier may generate a positive offset at the output terminal Vout, i.e. the output voltage (Vout) is equal to the input voltage (Vin) plus the positive offset (Vos), and the equivalent circuit diagram thereof is shown in FIG. 4A. Therefore, when the switches S1 and S2 in all of the chopper operational amplifiers $COP_1$~$COP_m$ are in the first state, two sets of gamma voltages with positive and negative data polarity respectively, which are generated by means of division via the resistors $R_1$~$R_i$, may have a positive offset.

Figure 3B:
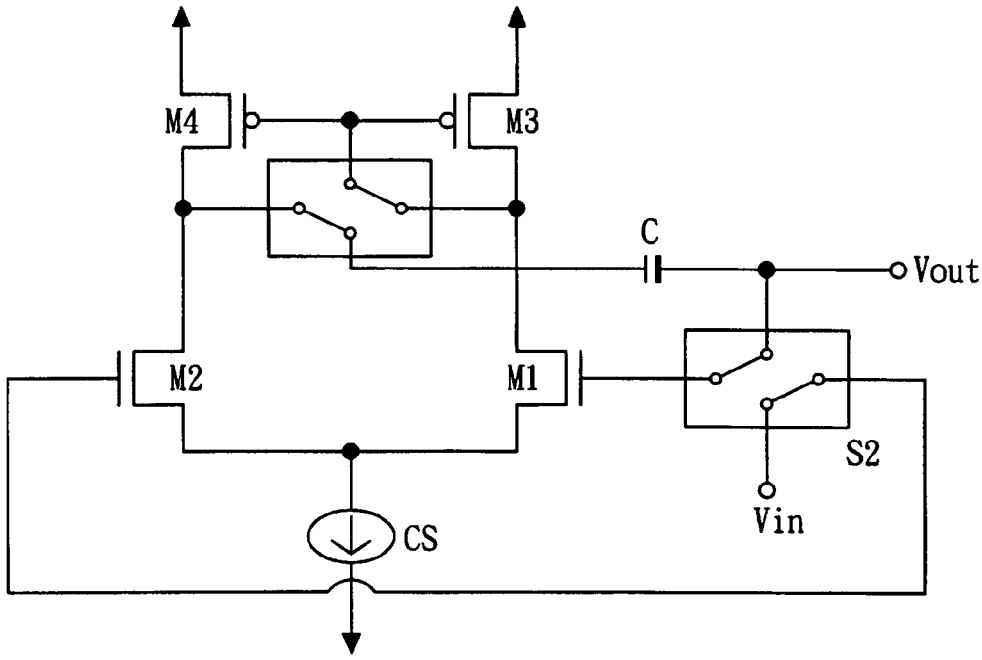
FIG. 3B illustrates the chopper operational amplifier, being operated in the second state.
Figure 4B:
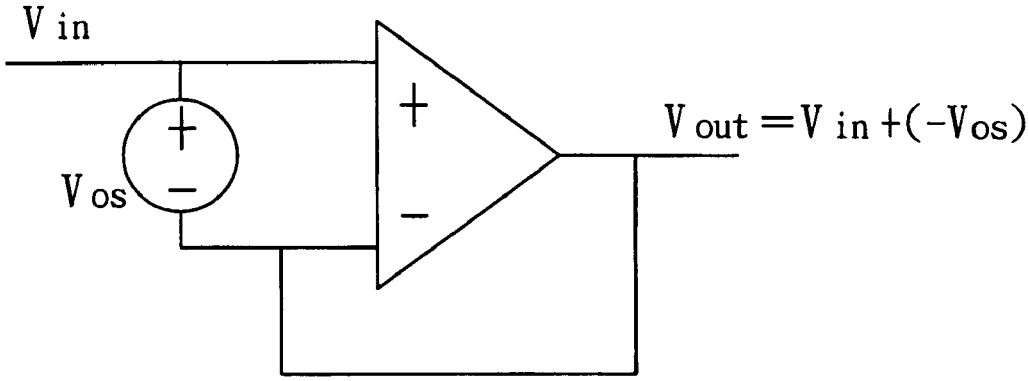
FIG. 4B is an equivalent circuit diagram of the chopper operational amplifier, being operated in the second state.

As shown in FIG. 3B, the switch S1 connects the gates of the transistors M3 and M4 to the drain of the transistor M3, and connects the drain of the transistor M4 to the capacitor C, while the switch S2 connects the gate of the transistor M2 to the input terminal Vin, and connects the gate of the transistor M1 to the output terminal Vout. As such, the chopper operational amplifier may generate a negative offset at the output terminal Vout, i.e. the output voltage (Vout) is equal to the input voltage (Vin) plus the negative offset (−Vos), and the equivalent circuit diagram thereof is shown in FIG. 4B. Therefore, when the switches S1 and S2 in all of the chopper operational amplifiers $COP_1$~$COP_m$ are in the second state, two sets of gamma voltages with positive and negative data polarity respectively, which are generated by means of division via the resistors $R_1$~$R_i$, may have a negative offset.

The operation of the data driving system in a first embodiment of the present invention is illustrated below, wherein dot inversion is adopted. FIG. 5 shows the data polarities and the offset polarities of the driving voltages of partial pixels (with only the image area of four data lines and eight scanning lines shown) in the band region driven by a data driving system 20 in one frame, wherein the symbols "+" and "−" inside the parenthesis indicate the offset polarity of the driving voltage, and the symbols "+" and"−" outside the parenthesis indicate the data polarity. In the driving mode of dot inversion, the data polarity of each pixel is opposite to that of the four neighboring pixels in one frame. On the other hand, the state of the switches in each of the chopper operational amplifiers $COP_1$~$COP_m$ is switched at the same time once every two scanning periods, which results in that the offset polarities in the gamma voltages and the offset polarities in the driving voltages are switched accordingly. As such, in one frame, the driving voltages of pixels on every third scanning line have opposite offset polarities. Because two kinds of pixels whose driving voltages have positive and negative offsets respectively are present in one frame at the same time, the offset is eliminated in space.

In addition to that the state of the switches in the chopper operational amplifiers $COP_1$~$COP_m$ is switched once every two scanning periods, the initial state to be switched is also changed once every two frame periods, which is illustrated with reference to FIG. 6 wherein four continuous frames (with only the image area of four data lines and eight scanning lines shown) are shown. Similarly, in FIG. 6, the symbols "+" and "−" inside the parenthesis indicate the offset polarity of the driving voltage, while the symbols "+" and "−" outside the parenthesis indicate the data polarity. In the driving mode of dot inversion, the data polarities of a given pixel at the same location in two sequential frames are opposite. Therefore, not only the data polarity of any pixel is opposite to that of the neighboring pixels in one frame, but also the data polarities at the same pixel location in the two sequential frames are opposite. On the other hand, the initial state of the switches in the chopper operational amplifiers $COP_1$~$COP_m$ is changed once every two frame periods, so that the offset polarities in the driving voltages at the same pixel location are opposite every three frame. Now take frames F1 and F3 as the example. In frame F1, the switches of the chopper operational amplifiers $COP_1$~$COP_m$ take the first state as the initial state, while in frame F3, the second state is taken as their initial state. Therefore, in frame F1, the driving voltage with a positive offset is produced first, while in frame F3, the driving voltage with a negative offset is produced first. It is shown in FIG. 6 that one pixel may have opposite polarity offsets in a former frame and a latter one, thus the offset is eliminated in time.

Therefore, the offset in the driving voltage is eliminated in space and time by switching the state of the switches in the chopper operational amplifiers periodically and changing the initial state of the switching sequence periodically. Because the offset in the driving voltage of each data driving system is eliminated, there is no band mura in the panel.

Next, the operation of the data driving system in a second embodiment of the present invention is illustrated, wherein two dot lines inversion is adopted. FIG. 7 shows the data polarities and the offset polarities of the driving voltages of partial pixels (with only the image area of four data lines and eight scanning lines shown) in the band region driven by a data driving system 20 in one frame, wherein the symbols "+" and "−" inside the parenthesis indicate the offset polarity of the driving voltage, and the symbols "+" and "−" outside the parenthesis indicate the data polarity. In the driving mode of two dot lines inversion, the data polarity of each pixel is opposite to that of the pixels to the right or left of or below such pixel or to the right or left of or above such pixel in one frame. On the other hand, the state of the switches in all of the chopper operational amplifiers $COP_1$~$COP_m$ is switched at the same time once every scanning period, which results in that the offset polarities in the gamma voltages and the offset polarities in the driving voltages are switched accordingly. As such, in one frame, the driving voltages of the pixels on each pair of adjacent scanning lines have opposite offset polarities. Because two kinds of pixels whose driving voltages have positive and negative offsets respectively are present in one frame at the same time, the offset is eliminated in space.

Figure 8:
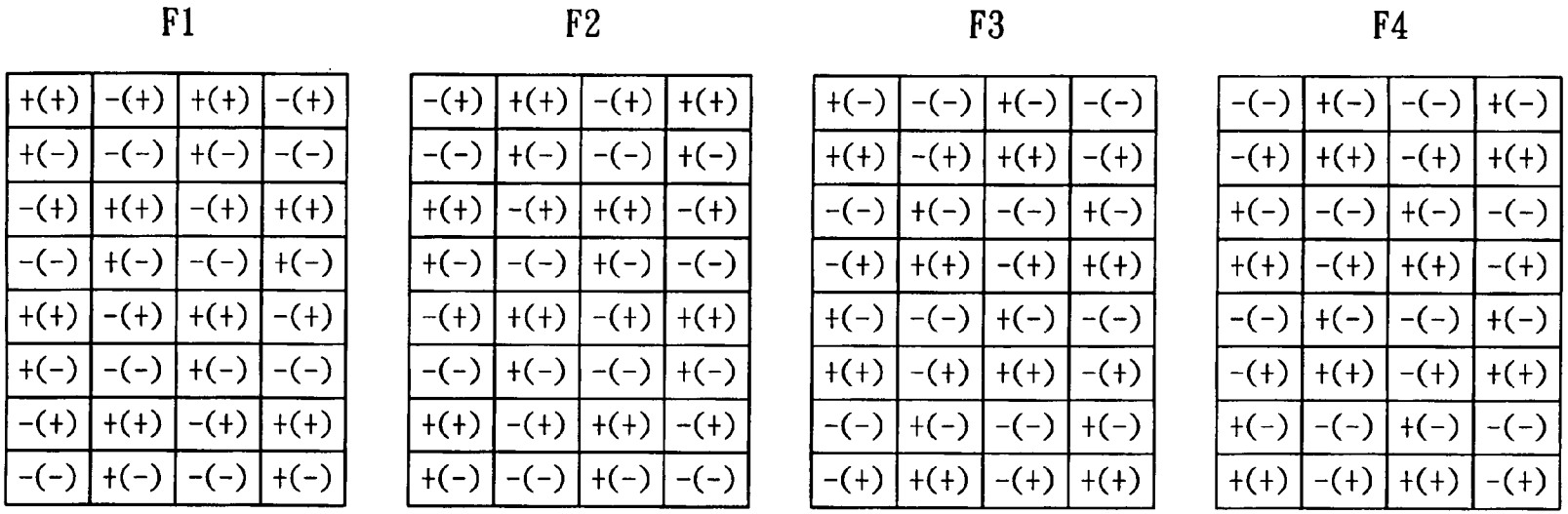
FIG. 8 illustrates the data polarities and the offset polarities of the pixels of four continuous frames in the second embodiment of the present invention.

In addition to that the state of the switches in the chopper operational amplifiers $COP_1$~$COP_m$ is switched once every scanning period, the initial state of switching is also changed once every two frame periods, which is illustrated with reference to FIG. 8 wherein four continuous frames (with only the image area of four data lines and eight scanning lines shown) are shown. Similarly, in FIG. 8, the symbols "+" and "−" inside the parenthesis indicate the offset polarity of the driving voltage, while the symbols "+" and "−" outside the parenthesis indicate the data polarity. In the driving mode of two dot lines inversion, the data polarities of a given pixel at the same location in two sequential frames are opposite. Therefore, not only is the data polarity of any pixel opposite to that of its neighbors in one frame, but also the data polarities at the same pixel location in two sequential frames are opposite. On the other hand, the initial state of the switches in the chopper operational amplifiers $COP_1$~$COP_m$ is changed once every two frame periods, so that the offset polarities in the driving voltages at the same pixel location are opposite every three frame. Now take frames F1 and F3 as the example. In frame F1, the switches of the chopper operational amplifiers $COP_1$~$COP_m$ take the first state as the initial state, while in frame F3, the second state is taken as the initial state.

Therefore, in frame F1, the driving voltage with a positive offset is produced first, while in frame F3, the driving voltage with a negative offset is produced first. It is shown in FIG. 8 that one pixel may have opposite polarity offsets during a former frame and a latter one, thus the offset is eliminated in time.

Therefore, the offset in the driving voltage is eliminated in space and time by switching the state of the switches in the chopper operational amplifiers periodically and changing the initial state of the switching sequence periodically. Because the offset in the driving voltage of each data driving system is eliminated, there is no band mura in the panel.

Although the present invention is illustrated by example of the driving mode of dot inversion and the driving mode of two dot lines, it is not limited to operation in the driving mode of dot inversion and the driving mode of two dot lines. In any other driving mode of data polarity inversion, the state of the switches in the chopper operational amplifiers may be switched periodically, so that pixels with opposite offset polarities of the driving voltages may be present in one frame, or the same pixel has opposite offset polarities of the driving voltages in different frames, thus the offset is eliminated in space and time.

However, the embodiments mentioned above are merely for illustrating the principle and the efficacy of the present invention, and are not intended to limit the scope of the present invention. Therefore, varieties and modifications may be made without departing from the spirit of the present invention by those skilled in the art. The scope of the present invention is as set forth in the following claims.

What is claimed is:

1. A data driving system for driving a panel, comprising:

a gamma voltage supply for producing a plurality of gamma voltages; and a D/A converter for receiving the gamma voltages, a first pixel value and a second pixel value, and converting each of the first pixel value and the second pixel value to a corresponding one of the gamma voltages;

wherein the gamma voltages have a first polarity offset when the D/A converter converts the first pixel value, and the gamma voltages have a second polarity offset when the D/A converter converts the second pixel value, and wherein the gamma voltage supply comprises a plurality of chopper operational amplifiers, via which a plurality of reference voltages are received respectively and thereby the gamma voltages are produced, and each chopper operational amplifier is operated in a first state when the D/A converter converts the first pixel value, so that the gamma voltages have the first polarity offset, and each chopper operational amplifier is operated in a second state when the D/A converter converts the second pixel value, so that the gamma voltages have the second polarity offset.

2. The data driving system according to claim 1, wherein the gamma voltage supply further comprises a plurality of resistors in series for division of the output voltages by the chopper operational amplifiers to produce the gamma voltages.

3. The data driving system according to claim 2, wherein the first polarity offset is a positive offset, and the second polarity offset is a negative offset.

4. The data driving system according to claim 1, further comprising an output buffer for receiving the corresponding gamma voltage output from the D/A converter and then outputting a driving voltage.

5. The data driving system according to claim 1, wherein the panel is driven in a dot inversion mode, and the locations of a first pixel corresponding to the first pixel value and a second pixel corresponding to the second pixel value are separated by two scanning lines.

6. The data driving system according to claim 1, wherein the panel is driven in a dot inversion mode, and the time interval between receiving the first pixel value and the second pixel value is two frame periods.

7. The data driving system according to claim 1, wherein the panel is driven in a two dot lines inversion mode, and locations of a first pixel corresponding to the first pixel value and a second pixel corresponding to the second pixel value are separated by one scanning line.

8. The data driving system according to claim 1, wherein the panel is driven in a two dot lines inversion mode, and the time interval between receiving the first pixel value and second pixel value is two frame periods.

9. A data driving method for driving a panel, comprising the steps of:

(a) receiving a reference voltage to produce a plurality of gamma voltages; and (b) receiving the gamma voltages, a first pixel value, and a second pixel value, and converting each of the first pixel value and the second pixel value to a corresponding one of the gamma voltages, wherein the gamma voltages have a first polarity offset when the first pixel value is converted, and the gamma voltages have a second polarity offset when the second pixel value is converted, and wherein in step (b), a plurality of reference voltages are received respectively via a plurality of chopper operational amplifiers, and thereby the gamma voltages are produced, and each chopper operational amplifier is operated in a first state when the first pixel value is converted, so that the gamma voltages have the first polarity offset, and each chopper operational amplifier is operated in a second state when the second pixel value is converted, so that the gamma voltages have the second polarity offset.

10. The data driving method according to claim 9, wherein the gamma voltages are produced by dividing the output voltages of the chopper operational amplifiers.

11. The data driving method according to claim 9, wherein the first polarity offset is a positive offset, and the second polarity offset is a negative offset.

12. The data driving method according to claim 9, wherein the panel is driven in a dot inversion mode, and the locations of a first pixel corresponding to the first pixel value and a second pixel corresponding to the second pixel value are separated by two scanning lines.

13. The data driving method according to claim 9, wherein the panel is driven in a dot inversion mode, and the time interval between receiving the first pixel value and second pixel value is two frame periods.

14. The data driving method according to claim 9, wherein the panel is driven in a two dot lines inversion mode, and the locations of a first pixel corresponding to the first pixel value and a second pixel corresponding to the second pixel value are separated by one scanning line.

15. The data driving method according to claim 9, wherein the panel is driven in a two dot lines inversion mode, and the time interval between receiving the first pixel value and the second pixel value is two frame periods.

* * * * *